US006980069B2

(12) United States Patent
O'Keeffe et al.

(10) Patent No.: US 6,980,069 B2
(45) Date of Patent: Dec. 27, 2005

(54) MAGNETIC DEVICE FOR A MAGNETIC TRIP UNIT

(75) Inventors: Thomas Gary O'Keeffe, Farmington, CT (US); Christian Daehler, Avon, CT (US); Biranchi Narayana Sahu, Orissa (IN); Varma Dantuluri, Secunderabad (IN)

(73) Assignee: General Electric Company, Schenectady, NY (US)

( * ) Notice: Subject to any disclaimer, the term of this patent is extended or adjusted under 35 U.S.C. 154(b) by 23 days.

(21) Appl. No.: 10/063,401

(22) Filed: Apr. 18, 2002

(65) Prior Publication Data

US 2003/0197581 A1 Oct. 23, 2003

(51) Int. Cl.[7] ..... H01H 75/12
(52) U.S. Cl. ..... 335/35; 335/174; 335/38
(58) Field of Search ..... 335/21–25, 35–45, 335/165–176

(56) References Cited

U.S. PATENT DOCUMENTS 2,824,191 A * 2/1958 Christensen ..... 337/50
3,421,123 A * 1/1969 Laubenheimer et al. ..... 335/35
4,719,438 A * 1/1988 Mrenna et al. ..... 335/38
5,250,918 A * 10/1993 Edds et al. ..... 335/35
5,381,120 A * 1/1995 Arnold et al. ..... 335/35
5,394,126 A * 2/1995 Grunert et al. ..... 335/42
5,670,922 A * 9/1997 Montague et al. ..... 335/35
5,870,008 A 2/1999 Pannenborg et al. ..... 335/35
6,194,982 B1 * 2/2001 Mrenna et al. ..... 335/35
6,218,920 B1 4/2001 Reichard et al. ..... 335/176
6,636,133 B2 * 10/2003 Raabe et al. ..... 335/18
2003/0174033 A1 * 9/2003 Daehler et al. ..... 335/35

* cited by examiner

*Primary Examiner*—Lincoln M Donovan
(74) *Attorney, Agent, or Firm*—Cantor Colburn LLP

(57) ABSTRACT

A method and magnetic trip unit for actuating a latching mechanism to trip a circuit breaker upon an overcurrent condition, the magnetic trip unit including: a first electrically conductive strap configured to conduct an electrical current; a first magnet yoke disposed proximate to the first electrically conductive strap; and a first armature pivotally disposed proximate to the first magnetic yoke in operable communication with the latching mechanism; the first armature providing a magnetic path having a reluctance to magnetic flux; and the reluctance is adjusted to prevent saturation of the magnetic flux when the current through the strap is a first number times a rated current of the circuit breaker and the reluctance is adjusted to promote saturation of magnetic flux when the current through the strap is a second number times the rated current of the circuit breaker, wherein the first number is a number smaller than the second number.

31 Claims, 6 Drawing Sheets

Torque Vs Gap

MAGNETIC DEVICE FOR A MAGNETIC TRIP UNIT

BACKGROUND OF INVENTION

Circuit breakers typically provide protection against the very high currents produced by short circuits. This type of protection is provided in many circuit breakers by a magnetic trip unit, which trips the circuit breaker's operating mechanism to open the circuit breaker's main current-carrying contacts upon a short circuit condition.

Modern magnetic trip units include a magnet yoke (anvil) disposed about a current carrying strap, an armature (lever) pivotally disposed near the anvil, and a spring arranged to bias the armature away from the magnet yoke. Upon the occurrence of a short circuit condition, very high currents pass through the strap. The increased current causes an increase in the magnetic field about the magnet yoke. The magnetic field acts to rapidly draw the armature towards the magnet yoke, against the bias of the spring. As the armature moves towards the yoke, the end of the armature contacts a trip lever, which is mechanically linked to the circuit breaker operating mechanism. Movement of the trip lever trips the operating mechanism, causing the main current-carrying contacts to open and stop the flow of electrical current to a protected circuit.

Currently, circuit breakers having a magnetic trip unit described above allow for adjusting the air gap distance between the magnet yoke and the armature to obtain different trip set points. The trip set point range offered by adjusting the distance between the magnet yoke and the armature is limited because a large trip set point range requires a large air gap adjustment range. Because available space is often limited, a smaller than desired adjustment range results. Furthermore, overcurrent protection at a low current trip setting (e.g., three times the rated current of the circuit breaker) is inhibited because the magnetically induced force acting on the armature isn't significant enough to trip the latch system.

Those skilled in the art will appreciate that the electrical load of a motor is characterized by a starting (run-up) current and a running current. The starting current averages about six times the full load current of the motor, but the peak of the first half cycle, the so-called "inrush" current, can reach values of up to twenty times the full load current. The lower overcurrent range for motor protection is commonly 3× the full load current of the motor.

It is necessary for such magnetic trip units to be reliable at a low overcurrent setting without altering the magnetically induced force acting on the armature at high overcurrent settings. In addition, it is desired that magnetic trip units offer a broader spectrum of overcurrent ranges (e.g., for use in motor protection), so that the breaker can offer a broader range to trip at different levels of overcurrent. It is also desired that the magnetic trip units be compact.

SUMMARY OF INVENTION

The above discussed and other drawbacks and deficiencies are overcome or alleviated by a magnetic trip unit for actuating a latching mechanism to trip a circuit breaker upon an overcurrent condition, the magnetic trip unit including: a first electrically conductive strap configured to conduct an electrical current; a first magnet yoke disposed proximate to the first electrically conductive strap; and a first armature pivotally disposed proximate to the first magnetic yoke in operable communication with the latching mechanism; the first armature providing a magnetic path having a reluctance to magnetic flux; and the reluctance is adjusted to prevent saturation of the magnetic flux when the current through the strap is a first number times a rated current of the circuit breaker and the reluctance is adjusted to promote saturation of magnetic flux when the current through the strap is a second number times the rated current of the circuit breaker, wherein the first number is a number smaller than the second number.

In an alternative embodiment, a method of increasing an induced magnetic force from a magnet yoke on a pivotally mounted armature of a trip unit in a circuit breaker at a low current without substantially altering the induced magnetic force acting on the armature at a high current, the method comprising: configuring the armature to provide a magnetic path having a reluctance to a magnetic flux; and adjusting the reluctance of the magnetic path to prevent saturation of the magnetic flux when a current through the trip unit is a first number times a rated current of the circuit breaker, and the magnetic path is generally saturated when the current through the circuit breaker is a second number times the rated current, wherein the first number is a number smaller than the second number.

BRIEF DESCRIPTION OF DRAWINGS

Referring to the drawings wherein like elements are numbered alike in the several Figures.

DETAILED DESCRIPTION

Figure 1:
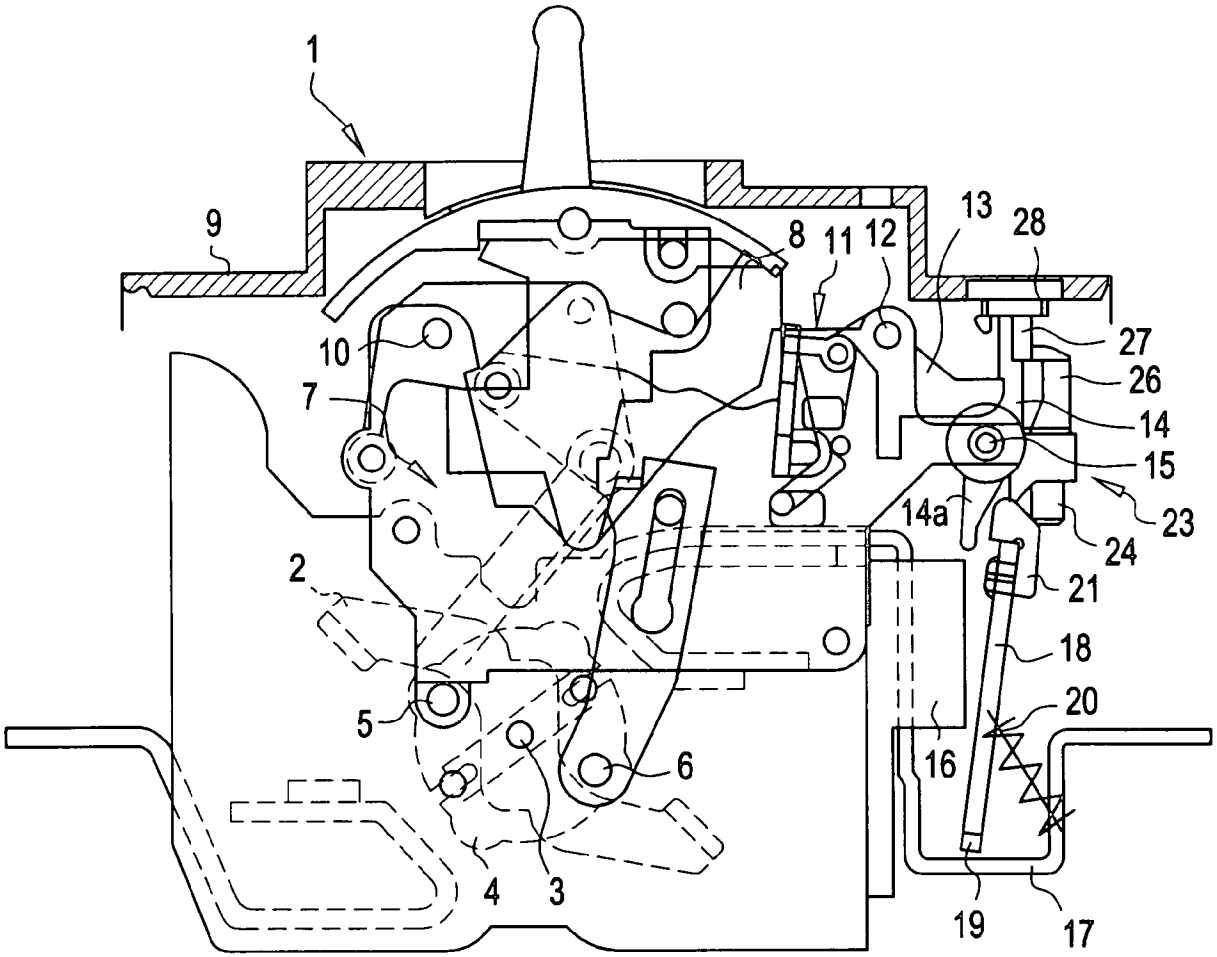
FIG. 1 is an elevation view of a circuit breaker with a magnetic trip unit.

A circuit breaker 1 equipped with an adjustable magnetic trip unit of the present disclosure is shown in FIG. 1. The circuit breaker 1 has a rotary contact arm 2, which is mounted on an axis 3 of a rotor 4 such that it can rotate. The rotor 4 itself is mounted in a terminal housing or cassette (not shown) and has two diametrically opposed satellite axes 5 and 6, which are also rotated about the axis 3 when the rotor 4 rotates. The axis 5 is the point of engagement for a linkage 7, which is connected to a latch 8. The latch 8 is mounted, such that it can pivot, on an axis 10 positioned on the circuit breaker housing 9. In the event of an overcurrent or short circuit condition, the latch 8 is released by a latching mechanism 11, moving the contact arm 2 to the open position shown in FIG. 1.

The latching mechanism 11 can be actuated by a trip lever 13 that pivots about an axis of rotation 12. The other end of the trip lever 13 contacts a trip shaft 14, which is mounted on an axis 15 supported by the circuit breaker housing 9. Disposed on the trip shaft 14 is a cam 14*a*, which can be pivoted clockwise in opposition to the force of a torsional spring 14*b* wound about the axis 15.

Mounted to the circuit breaker housing 9 in the bottom region of the circuit breaker is a rotational solenoid type magnetic assembly comprising a magnet yoke 16 and a biased armature 18. Magnet yoke 16 encircles a current carrying strap 17 electrically connected to one of the contacts of the circuit breaker 1. Arranged facing the magnet yoke is the armature 18 in the form of a metallic lever, which is hinge-mounted by means of hinge pin sections 19 to hinge knuckles (not shown) formed on the circuit breaker housing 9. The armature 18 is also connected to strap 17 by a spring 20, which biases the armature 18 in the clockwise direction, away from the magnet yoke 16. In its upper region, armature 18 is equipped with a clip 21 rigidly mounted thereon, which can be brought into contact with the cam 14*a* by pivoting of the armature in a counter-clockwise direction. Movement of cam 14*a* by the armature 18 causes the trip shaft 14 to rotate about axis 15 and thereby actuate the latching mechanism 11 by means of the trip lever 13. Once actuated, latching mechanism 11 releases latch 8 to initiate the tripping process in circuit breaker 1. While the clip 21 is described herein as being mounted to armature 18, the clip 21 can also be formed as one piece with the armature 18, preferably of metal.

Figure 2:
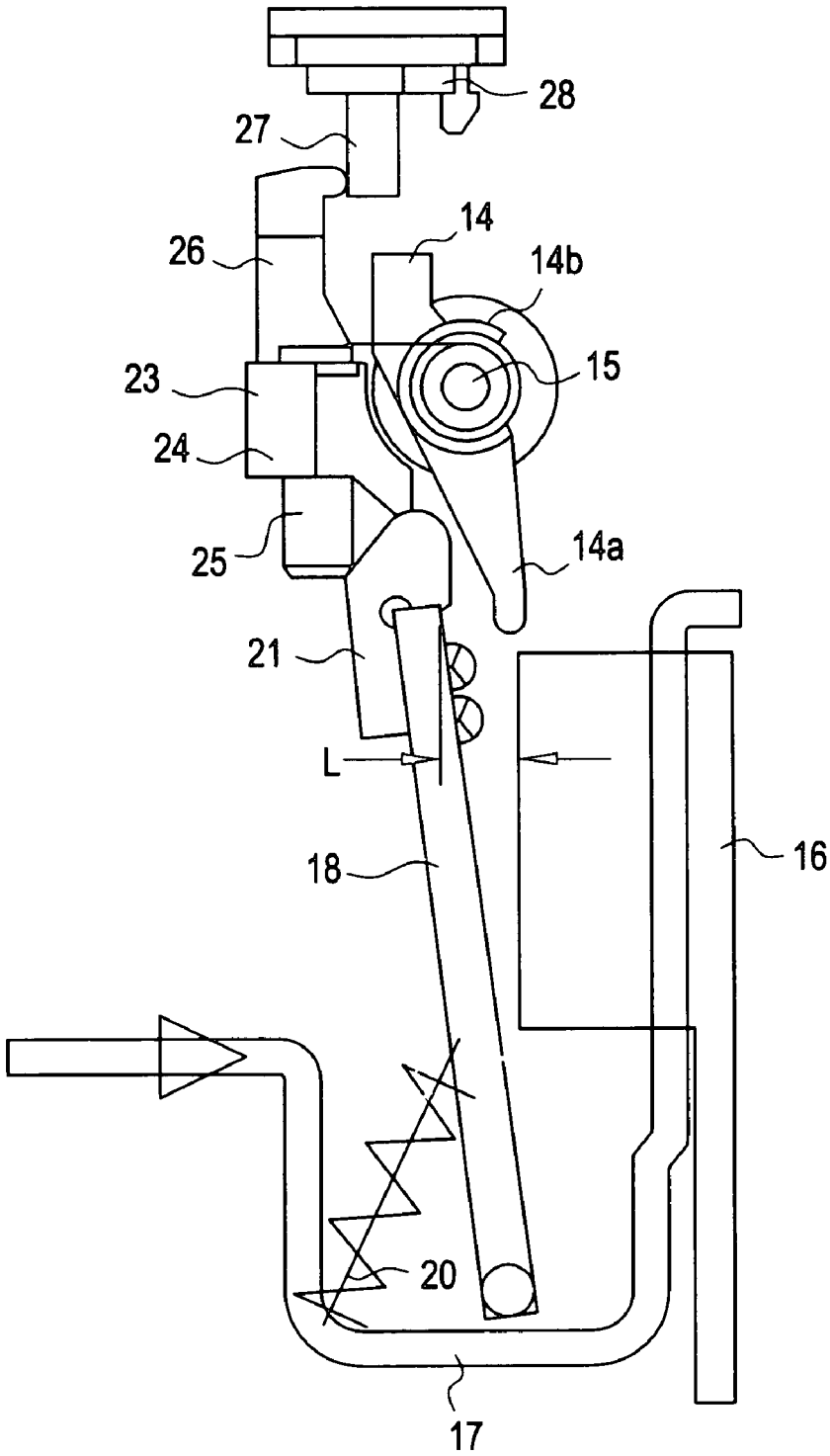
FIG. 2 is an elevation view of the magnetic trip unit from the circuit breaker of FIG. 1.
Figure 3:
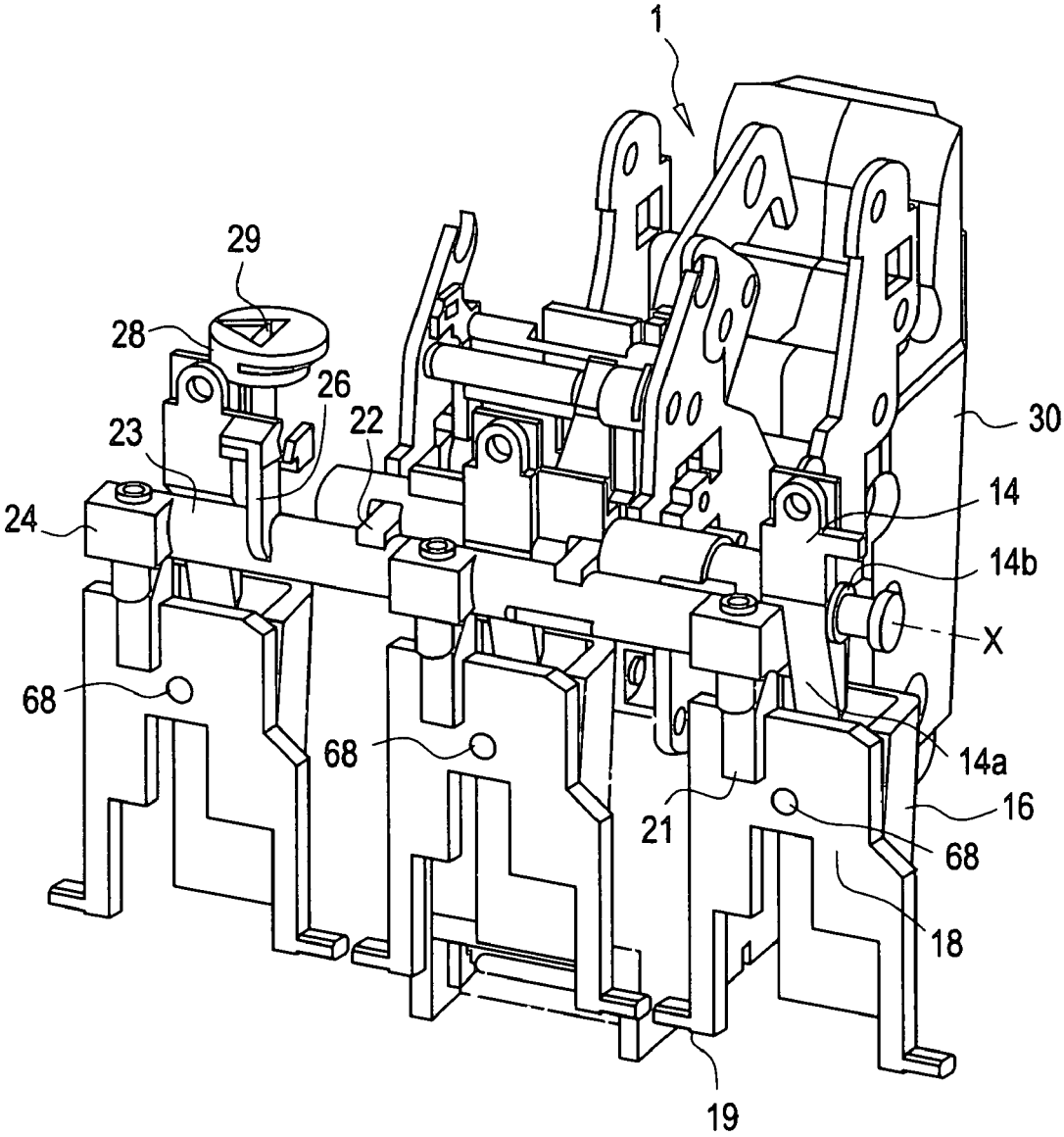
FIG. 3 is a perspective view of a multi-pole circuit breaker including the magnetic trip unit of FIG. 2.

Referring now to FIG. 2 and FIG. 3, an adjusting bar 23 extends parallel to the axis 15 and is mounted on the axis 15, by means of support arms 22. The adjusting bar 23 has an adjusting arm 24 which is threadably engaged to an adjusting screw 25 for calibrating the trip unit. Adjusting bar 23 also includes a lever arm 26 which extends to a side of the adjusting bar 23 diametrically opposite adjusting arm 24. A top end of the lever arm 26 is in contact with a cam pin 27 of a rotary knob 28, which is mounted in a hole in the upper wall of the circuit breaker housing 9 (FIG. 1). The surface of the rotary knob 28 is equipped with a slot 29 to make it possible to adjust the rotary knob 28 with the aid of a suitable tool, such as a screwdriver.

In the unactuated state of the magnet yoke 16, which is to say when the contact arm 2 (FIG. 1) is closed and an overcurrent is not present, the adjusting screw 25 is in constant contact with an angled surface of the clip 21. Contact between adjusting screw 25 and the angled surface of the clip 21 is ensured by a tensile force exerted by the spring 20 on the armature 18. The force of the angled surface of the clip 21 on adjusting screw 25 biases the adjusting bar 23 in a clockwise direction about axis 15, thus forcing lever arm 26 away from yoke 16 and against pin 27. In this state, it is possible to change the tilt setting of the armature 18 either by extending (or retracting) adjusting screw 25 downward from (upward to) adjusting arm 24, or by rotating the adjusting bar 23 about axis 15 by adjusting the rotary knob 28. Thus, the distance L shown in FIG. 2 between the armature 18 and the magnet yoke 16 is adjusted, thereby setting the current level at which the trip unit responds.

The circuit breaker with adjustable magnetic trip unit shown in FIGS. 1, 2, and 3 operates as follows. First, a person adjusting the circuit breaker 1 by turning rotary egg knob 28 sets the position of the adjusting bar 23 on the axis 15 and thus the distance between the armature 18 and the magnet yoke 16, as shown in detail in FIG. 2. Because of the relatively greater length of the lever arm 26 as compared to the adjustable arm 24, the adjustment made by rotary knob 28 is fine. It must be noted here that a coarser adjustment of the gap L between the magnet yoke 16 and the armature 18 can be accomplished by turning the adjusting screw 25 during installation of the trip unit in the circuit breaker housing 9.

In the case of a short circuit, an overcurrent naturally occurs, which flows through the current carrying strap 17. This activates the magnet yoke 16 to the extent that when a specific current is exceeded, the magnetic force generated by the magnet yoke is sufficient to attract the armature 18 in opposition to the tensile force exerted by the spring 20. Armature 18 pivots towards yoke 16, and the cam 14*a* is pivoted clockwise in FIG. 1 (counter-clockwise in FIG. 2) by the clip 21 until the trip lever 13 is actuated. Actuation of the trip lever 13 then tilts the latching mechanism 11 such that it in turn can release the latch 8 for a pivoting motion, upward in FIG. 1, about the axis 10. This motion is caused by a spring, which is not shown in detail in FIG. 1. The motion of the linkage 7 that is coupled with the pivoting motion of the latch 8 brings about a rotation of the rotor 4 by means of the axis 5, and thus finally a disconnection of the contact arm 2 from the current carrying straps.

As shown in FIG. 3, the trip unit can be arranged for use in a circuit breaker 1 having a plurality of breaker cassettes 30, with each cassette 30 having its own contact arm 2 and rotor 4 arrangements. While only one cassette 30 is shown, it will be understood that one cassette 30 is used for each phase in the electrical distribution circuit. Adjusting bar 23 extends along the row of circuit breaker cassettes 30, parallel to the axis 15 of the trip shaft 14. Extending from adjusting bar 23 are several adjusting arms 24 corresponding to the number of circuit breaker cassettes 30. Also formed on the adjusting bar 23 is one lever arm 26, which is sufficient to rotate the adjusting bar 23 about axis 15 and, thus, pivot the armatures 18. The tripping sensitivity in each circuit breaker cassette 30 can be adjusted separately by means of the screws 25 carried by each adjusting arm 24. As a result, individual calibration of each circuit breaker cassette 30 can be undertaken independently of the adjustment of rotary knob 28.

Figure 4:
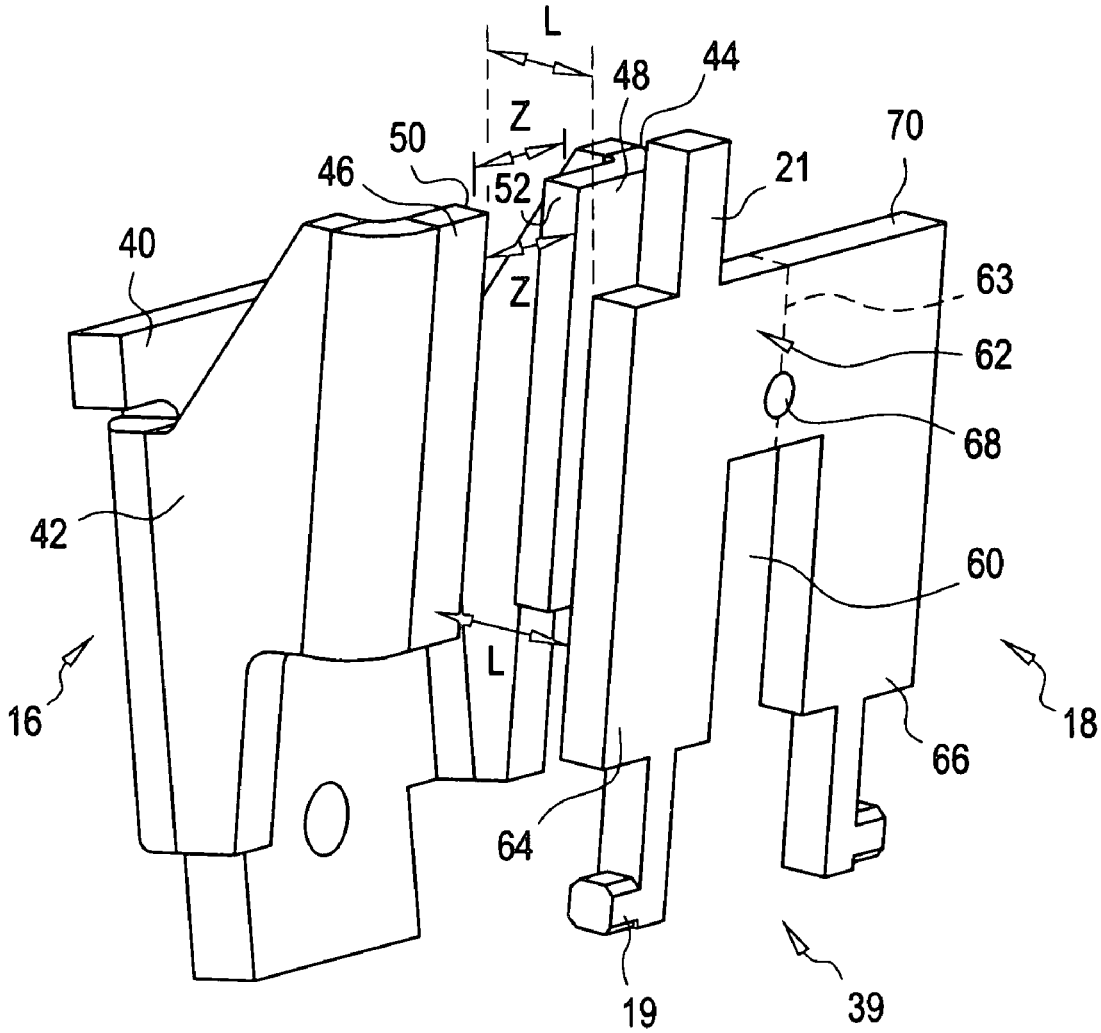
FIG. 4 is a perspective view of an armature and yoke of the magnetic trip unit in FIG. 3.

Referring to FIG. 4, a perspective view of an exemplary embodiment of armature 18 and yoke 16 of a magnetic trip unit assembly is illustrated. The magnet yoke 16 is shaped from a ferrous steel plate to define a backwall 40 having side arms 42, 44 extending generally perpendicularly from backwall 40 towards armature 18. Each of side arms 42, 44 includes a flange 46, 48 extending generally perpendicularly therefrom to form a four-sided enclosure. Flanges 46 and 48 form an increased pole face area over that offered by side arms 42, 44. Flanges 46, 48 further include a gap 'z' (pole face gap z) between edges 50, 52 of the flanges 46, 48.

The armature 18 comprises of generally a flat metallic plate having a portion of material removed in the form of a rectangle 60. Above rectangle 60 is a crossbeam component 62 of armature 18 that joins legs 64, 66. Crossbeam 62 includes an aperture 68 formed therein for attaching one end of spring 20. Clip 21 is formed at a top edge 70 of armature 18.

Electrical current passing through strap 17 (FIG. 2) induces magnetic flux in yoke 16 and armature 18. Accordingly, a magnetic relationship exists between the length of the flanges 46 and 48 of the magnet yoke 16 and armature 18 that is dependent on gap L that separates the flanges 46, 48 from the armature 18 and gap z that separate edges 50, 52. The magnetic flux generated within the flux concentrating magnet yoke 16 seeks the path of least magnetic reluctance. The path of least reluctance is the shorter of the gaps z or L. By maintaining the gap z greater than the gap L, the flux gathers between the flux concentrator magnet side arms 42, 44, thereby driving the flux concentration within arms 42 and 44 to a high value.

Because of the high flux concentration within arms 42 and 44, larger magnetic forces are generated at lower current levels resulting in more force generated at clip 21 to trip the latch mechanism (i.e., cam 14*a*). The added force is beneficial at low current trip settings (e.g., three times the rated current) where the low current is otherwise not enough to induce sufficient magnetic force on armature 18 to trip the latch system. For higher trip settings, however, this added force is not needed and may cause damage to the trip latch system. Therefore, the armature 18 is pivoted away from yoke 16, thereby increasing gap L until it is greater than gap z. With gap L greater than gap z, yoke 16 shunts the magnetic flux from yoke 16 onto itself because the flux seeks the path of least magnetic reluctance. Accordingly, the magnetic force of yoke 16 on armature 18 is reduced. However, a further reduction in magnetic force may be needed. To achieve this reduction, an amount of material is removed from armature 18 such that armature 18 does not saturate at low current settings (e.g., having a maximum flux density of approximately 1.9 T ($B_{MAX}$) before saturation flux density ($B_{SAT}$) of steel at 2.0 T) and saturates at high current settings. Because the armature does not saturate at low current settings, armature 18 does not affect the increase of the magnetically induced force due to the increased pole face area of flanges 46, 48 acting on cross beam component 62 at low current settings.

More specifically, the reluctance of a magnetic circuit is analogous to the resistance of an electric circuit. Reluctance depends on the geometrical and material properties of the circuit that offer opposition to the presence of magnetic flux. Reluctance of a given part of a magnetic circuit is proportional to its length and inversely proportional to its cross-sectional area and a magnetic property of the given material called its permeability ($\mu$). Iron, for example, has an extremely high permeability as compared to air so that it has a comparatively small reluctance, or it offers relatively little opposition to the presence of magnetic flux. Thus, it will be appreciated that opposition to an increase in magnetic flux and hence reaching saturation, is optionally controlled by selecting the length and cross-sectional area of the magnetic path or selecting a material with a permeability that is near saturation when the gap is small and approaches saturation as the gap increases. The magnetic path length is defined by the width of armature 18 and a cross section area 63 of cross beam 62. Cross section area 63 of cross beam 62 is selected to obtain a reluctance that provides favorable magnetic properties at both small gaps L and large gaps L (i.e., first distances and second distances larger than first distances).

By setting the cross section area 63 based on low current requirements, armature 18 saturates at high current settings which results in a lower relative induced magnetic force. When an emanating magnetic field H permeates through a cross-section area of a medium (i.e., cross section area 63), it converts to magnetic flux density B according to the following formula: B magnetic flux density=$\mu$ H magnetic field where $\mu$ is the permeability of the medium. Flux density (B) is simply the total flux ($\phi$) divided by the cross sectional area ($A_e$) of the part through which it flows—$B=\phi/A_e$ teslas Initially, as current is increased the flux ($\phi$) increases in proportion to it. At some point, however, further increases in current lead to progressively smaller increases in flux. Eventually, the armature 18 can make no further contribution to flux growth and any increase thereafter is limited to that provided by the permeability of free space ($\mu$ 0)—perhaps three orders of magnitude smaller. It will be appreciated that the missing material to form aperture 68 must be accounted for in the minimum cross sectional area ($A_e$) calculation for the flux density (B) in armature 18 cross beam component 62.

Figure 5:
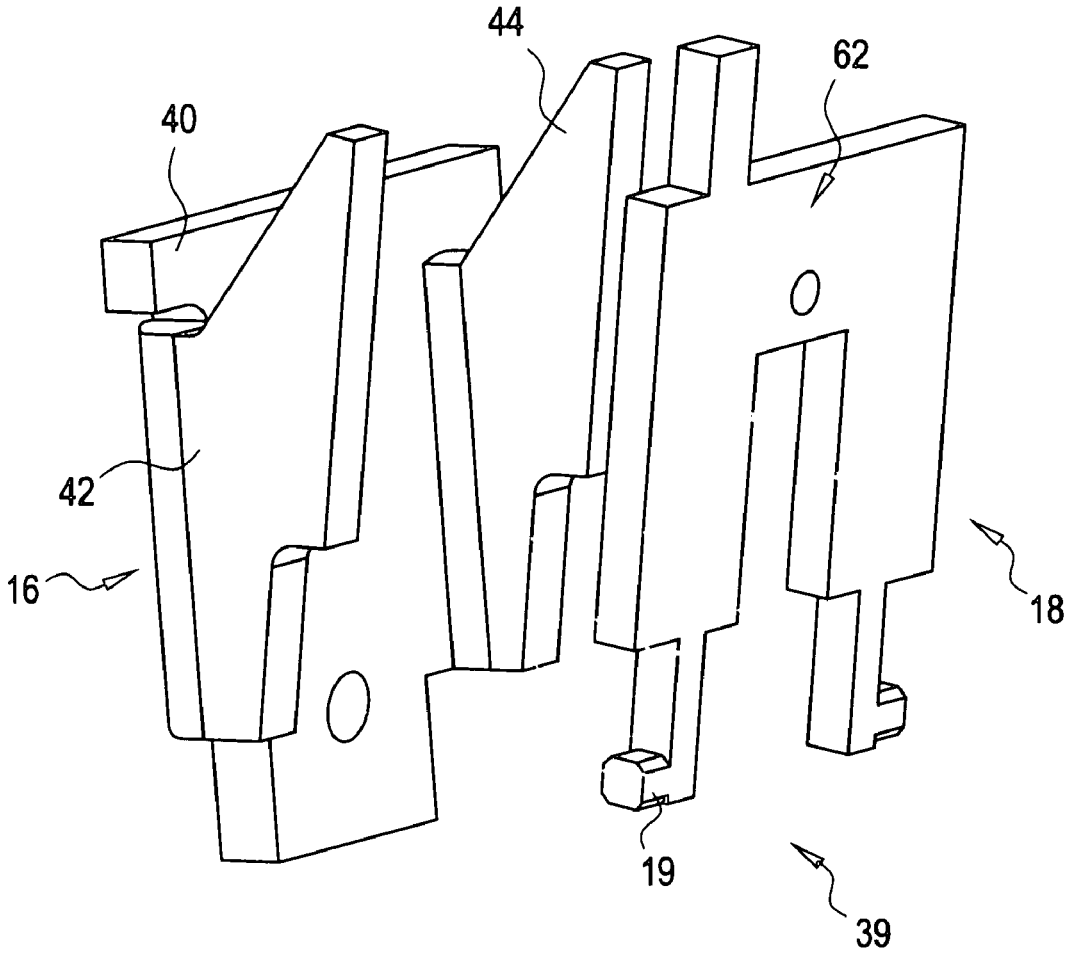
FIG. 5 is a perspective view of an alternative embodiment of the yoke shown in FIG. 4.
Figure 6:
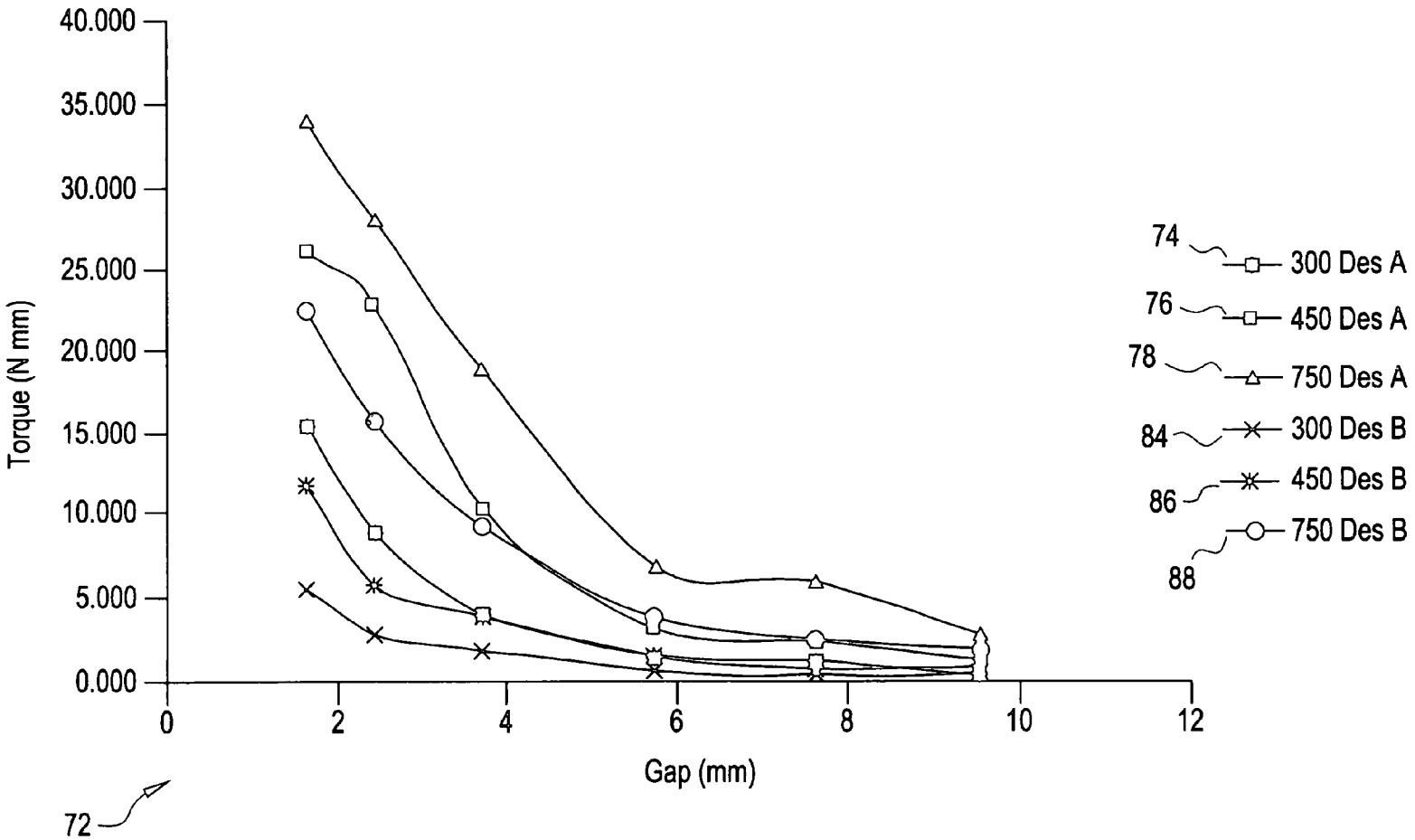
FIG. 6 is a graph illustrating the relationship between the induced force and gap distance of two different armature configurations shown in FIGS. 4 and 5.

Turning to FIGS. 5 and 6, FIG. 5 illustrates a yoke 16 without an increase in pole face area provided by flanges 46 and 48 extending from side arms 42 and 44. FIG. 6 illustrates the relationship between the induced force/torque and gap distance of the two different yoke configurations shown in FIGS. 4 and 5. In FIG. 6 of the drawings, the force/torque versus gap graph 72 shows the different electromagnetic force levels recorded at different magnetic force levels ($F_m$)(I×N ampere-turns) at different gap distances (L) utilizing two different yoke 16 configurations (FIGS. 4 and 5). Based on the characteristic curves, one can easily see that the magnetically induced force/torque is substantially increased at small gap distances with a yoke 16 configured having inwardly facing flanges 46 and 48, while at larger gap distances the magnetically induced force is basically unchanged between the two configurations. More specifically, curves 72, 76, and 78 indicate a yoke with flanges 46 and 48. Curves 84, 86, and 88 indicate a yoke without flanges 46 and 48. Curves 74 and 84 illustrate the torque at 3× the rated current, curves 76 and 86 illustrate the torque at 4.5× the rated current, and curves 78 and 88 illustrate the torque characteristic at 7.5× the rated current. In each case tested, the torque at a specific gap was substantially larger, about 10 N mm more, using a yoke with flanges 46, 48 (FIG. 4) than a yoke 16 without flanges 46, 48 (FIG. 5) at a first distance such as a low gap setting, i.e., about 2 mm. However, as the gap L increased, the resultant torque is substantially the same between the two yoke configurations. The reduction in the magnetically induced force at the high current settings (large gaps) due to saturation and due to the flux shunt yoke effect described above, allows a magnetic force that remains unchanged at a second distance such as a high current setting (large gap).

Thus, the above described yoke-armature system having a yoke with inwardly facing flanges with a gap z therebetween provides the necessary torque to trip the latch mechanism at small gaps (low current setting), while providing a torque that remains virtually unchanged at larger gaps (high current setting).

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A magnetic trip unit for actuating a latching mechanism to trip a circuit breaker upon an overcurrent condition, the magnetic trip unit including:

a first electrically conductive strap configured to conduct an electrical current;

a first magnet yoke disposed proximate to said first electrically conductive strap, said first magnet yoke comprising inwardly extended flanges defining a gap "z" therebetween; and a first armature pivotally disposed proximate to and adjustable to define a first and a second distance "L" from said inwardly extended flanges of said first magnetic yoke; said first armature being in operable communication with the latching mechanism; said first armature and said first magnet yoke providing a magnetic path therebetween; said magnetic path therebetween consisting of spaced apart facing surfaces of each of said first armature and said first magnet yoke; said magnetic path therebetween having a reluctance to magnetic flux; said reluctance is adjusted to prevent saturation of said magnetic flux when said current through said strap is a first number (X) times a rated current of the circuit breaker and said reluctance is adjusted to promote saturation of said magnetic flux when said current through said strap is a second number (Y) times said rated current of the circuit breaker; wherein said first number is a number smaller than said second number;

wherein in response to a first current through said strap being about 3 times a rated current of the circuit breaker, and said first distance "L" being less than said gap "z", a first magnetic torque is developed at said first armature;

wherein in response to said first current through said strap, and said second distance "L" being greater than said gap "z", a second magnetic torque is developed at said first armature; and wherein said first magnetic torque is equal to or greater than about 3 times said second magnetic torque.

2. The magnetic trip unit of claim 1, wherein said reluctance is adjusted by setting a length of said magnetic path to prevent saturation of said magnetic flux when said current through said strap is said first number times a rated current of the circuit breaker and said length generally saturates with said magnetic flux when said current through said strap is said second number times said rated current of the circuit breaker.

3. The magnetic trip unit of claim 1, wherein said reluctance includes a cross sectional area of said magnetic path to prevent saturation of said magnetic flux when said current through said strap is said first number times a rated current of the circuit breaker and said cross sectional area generally saturates with said magnetic flux when said current through said strap is said second number times said rated current of the circuit breaker.

4. The magnetic trip unit of claim 1, wherein said reluctance allows a flux density below a saturation flux density at said first number times said rated current.

5. The magnetic trip unit of claim 1, wherein said reluctance allows increases in said magnetic flux across said magnetic path without saturating when said current through said strap is said first number times said rated current and said magnetic flux approaches saturation as said current through said strap increases towards said second number times said rated current.

6. The magnetic trip unit of claim 1, wherein said first magnetic yoke includes a metal plate comprising a U-shaped bight.

7. The magnetic trip unit of claim 6, wherein said U-shaped bight includes of said inwardly extending flanges extending from opposite ends of said U-shaped bight; said gap "z" disposed between said flanges; said gap "z" being spaced for maximum flux egress from side edges of said flanges to said first armature; said flanges being arranged to generate a magnetic flux within said plate in response to said current through said first electrically conductive strap.

8. The magnetic trip unit of claim 7, wherein said gap is larger than a first distance separating said first armature and said first magnet yoke; said first distance provides less said reluctance for said magnetic flux than said gap.

9. The magnetic trip unit of claim 8, wherein said first armature is positioned at said first distance from said magnet yoke when the circuit breaker trips at said X times said rated current.

10. The magnetic trip unit of claim 7, wherein said gap is smaller than a second distance separating said first armature and said first magnet yoke; said second distance provides more said reluctance for said magnetic flux than said gap.

11. The magnetic trip unit of claim 10, wherein said armature is positioned at said second distance from said magnet yoke when the circuit breaker trips at said Y times said rated current.

12. The magnetic trip unit of claim 1, wherein said armature is attached to said first electrically conductive strap.

13. A circuit breaker including:

a first contact arm arranged between first and second electrically conductive straps;

a latching mechanism configured to move said first contact arm out of contact with said first and second electrically conductive straps;

a first magnet yoke disposed proximate to said first electrically conductive strap, said first magnet yoke comprising inwardly extended flanges that define a gap "z" therebetween; and a first armature pivotally disposed proximate to and adjustable to define a first and a second distance "L" from said inwardly extended flanges of said first magnetic yoke; said first armature being in operable communication with the latching mechanism; said first armature and said first magnet yoke providing a magnetic path therebetween; said magnetic path therebetween consisting of spaced apart facing surfaces of each of said first armature and said first magnet yoke; said magnetic path therebetween having a reluctance to magnetic flux; said reluctance is adjusted to prevent saturation of said magnetic flux when said current through said strap is a first number (X) times a rated current of the circuit breaker and said reluctance is adjusted to promote saturation of said magnetic flux when said current through said strap is a second number (Y) times said rated current of the circuit breaker; wherein said first number is a number smaller than said second number;

wherein in response to a first current through said strap being about 3 times a rated current of the circuit breaker, and said first distance "L" being less than said gap "z", a first magnetic torque is developed at said first armature;

wherein in response to said first current through said strap, and said second distance "L" being greater than said gap "z", a second magnetic torque is developed at said first armature; and wherein said first magnetic torque is equal to or greater than about 3 times said second magnetic torque.

14. The circuit breaker of claim 13, wherein said reluctance is adjusted by setting a length of said magnetic path to prevent saturation of said magnetic flux when said current through said strap is said first number times a rated current of the circuit breaker and said length generally saturates with said magnetic flux when said current through said strap is said second number times said rated current of the circuit breaker.

15. The circuit breaker of claim 13, wherein said reluctance allows a flux density below a saturation flux density at said first number times said rated current.

16. The circuit breaker of claim 13, wherein said reluctance allows increases in said magnetic flux across said magnetic path without saturating when said current through said strap is said first number times said rated current and said magnetic flux approaches saturation as said current through said strap increases towards said second number times said rated current.

17. The circuit breaker of claim 13, wherein said first magnetic yoke includes a metal plate comprising a U-shaped bight.

18. The circuit breaker of claim 17, wherein said U-shaped bight includes a pair of flanges extending from opposite ends of said U-shaped bight and a gap between said flanges; said gap being spaced for maximum flux egress from side edges of said flanges to said first armature; said flanges being arranged to generate a magnetic flux within said plate in response to said current through said first electrically conductive strap.

19. The circuit breaker of claim 18, wherein said gap is larger than a first distance separating said first armature and said first magnet yoke; said first distance provides less said reluctance for said magnetic flux than said gap.

20. The circuit breaker of claim 19, wherein said first armature is positioned at said first distance from said magnet yoke when the circuit breaker trips at said X times said rated current.

21. The circuit breaker of claim 18, wherein said gap is smaller than a second distance separating said first armature and said first magnet yoke; said second distance provides more said reluctance for said magnetic flux than said gap.

22. The circuit breaker of claim 21, wherein said armature is positioned at said second distance from said magnet yoke when the circuit breaker trips at said Y times said rated current.

23. The circuit breaker of claim 13, wherein said armature is attached to said first electrically conductive strap.

24. A magnetic trip unit for actuating a latching mechanism to trip a circuit breaker upon an overcurrent condition, the magnetic trip unit including:

a first magnet yoke configured to conduct an electrical current, said first magnetic yoke configured as a U-shaped bight defined by flanges extending toward each other having a gap "z" therebetween; and a first armature pivotally disposed proximate to said first magnetic yoke in operable communication with the latching mechanism, said first armature and said first magnet yoke adjustable for providing a magnetic path therebetween having a first distance "L" and a second distance "L" separating said first armature and said magnet yoke, said magnetic path therebetween consisting of spaced apart facing surfaces of each of said first armature and said first magnet yoke, said magnetic path therebetween having a reluctance to magnetic flux;

wherein in response to a first current through said strap being about 3 times a rated current of the circuit breaker, and said first distance "L" being less than said gap "z", a first magnetic torque is developed at said first armature;

wherein in response to said first current through said strap, and said second distance "L" being greater than said gap "z", a second magnetic torque is developed at said first armature; and wherein said first magnetic torque is equal to or greater than about 3 times said second magnetic torque.

25. The magnetic trip unit of claim 24, wherein said gap "z" is larger than said first distance "L" separating said first armature and said first magnet yoke; said first distance provides less said reluctance for said magnetic flux than said gap.

26. The magnetic trip unit of claim 24, wherein said gap "z" is smaller than said second distance "L" separating said first armature and said first magnet yoke; said second distance provides more said reluctance for said magnetic flux than said gap.

27. The magnetic trip unit of claim 1, wherein:

said first magnetic torque is equal to or greater than about 7 times said second magnetic torque.

28. The magnetic trip unit of claim 1, wherein:

in response to a second current through said strap being about 7.5 times the rated current of the circuit breaker, and said first distance "L" being less than said gap "z", a third magnetic torque is developed at said first armature;

in response to said second current through said strap, and said second distance "L" being greater than said gap "z", a fourth magnetic torque is developed at said first armature; and said third magnetic torque is equal to or greater than about 6 times said fourth magnetic torque.

29. The magnetic trip unit of claim 28, wherein:

said third magnetic torque is equal to or greater than about 8 times said fourth magnetic torque.

30. A magnetic trip unit for actuating a latching mechanism to trip a circuit breaker upon an overcurrent condition, the magnetic trip unit comprising:

an electrically conductive strap configured to conduct an electrical current;

a magnet yoke disposed proximate to said electrically conductive strap, said magnet yoke comprising inwardly extended flanges that define a gap "z" therebetween and that partially surround said electrically conductive strap; and an armature pivotally disposed proximate to and adjustable to define a first and a second distance "L" from said inwardly extended flanges of said magnetic yoke; said armature being in operable communication with the latching mechanism;

wherein in response to a first current through said strap being about 3 times a rated current of the circuit breaker, and said first distance "L" being less than said gap "z", a first magnetic torque is developed at said armature;

wherein in response to said first current through said strap, and said second distance "L" being greater than said gap "z", a second magnetic torque is developed at said armature;

wherein said first magnetic torque is equal to or greater than about 3 times said second magnetic torque;

wherein in response to a second current through said strap being about 7.5 times the rated current of the circuit breaker, and said first distance "L" being less than said gap "z", a third magnetic torque is developed at said armature;

wherein in response to said second current through said strap, and said second distance "L" being greater than said gap "z", a fourth magnetic torque is developed at said armature; and wherein said third magnetic torque is equal to or greater than about 6 times said fourth magnetic torque.

31. The magnetic trip unit of claim 30, wherein:

said third magnetic torque is greater than said first magnetic torque; and said fourth magnetic torque is about equal to said second magnetic torque.

* * * * *

UNITED STATES PATENT AND TRADEMARK OFFICE

CERTIFICATE OF CORRECTION

PATENT NO. : 6,980,069 B2
APPLICATION NO. : 10/063401
DATED : December 27, 2005
INVENTOR(S) : O'Keeffe et al.

It is certified that error appears in the above-identified patent and that said Letters Patent is hereby corrected as shown below:

Column 1:
Line 66, after "first" delete "magnetic" and insert therefor -- magnet --

Column 4:
Line 44, after "18" delete "comprises" and insert therefor -- is comprised --

Column 6:
Line 15, after "curves" delete "72" and insert therefor -- 74 --
Line 58, before "yoke" delete "netic" and insert therefor -- net --

Column 7:
Line 45, before "yoke" delete "magnetic" and insert therefor -- magnet --
Line 48, after "includes" delete "of"
Line 62, after "said" delete "X" and insert therefor -- first number (X) --

Column 8:
Line 3, before "said" delete "Y" and insert therefor -- second number (Y) --
Line 22, before "yoke" delete "netic" and insert therefor -- net --
Line 29, after "reluctance" delete "is" and insert therefor -- being --

Column 9:
Line 2, before "yoke" delete "magnetic" and insert therefor -- magnet --
Line 18, after "said" (first occurrence) delete "X" and insert therefor
-- first number (X) --
Line 26, after "said" (first occurrence) delete "Y" and insert therefor
-- second number (Y) --
Line 38, before "yoke" delete "magnetic" and insert therefor -- magnet --

UNITED STATES PATENT AND TRADEMARK OFFICE

CERTIFICATE OF CORRECTION

PATENT NO. : 6,980,069 B2
APPLICATION NO. : 10/063401
DATED : December 27, 2005
INVENTOR(S) : O'Keeffe et al.

It is certified that error appears in the above-identified patent and that said Letters Patent is hereby corrected as shown below:

Column 10:
Line 34, after "said" (second occurrence) delete "magnetic" and insert therefor
-- magnet --

Signed and Sealed this

Twenty-second Day of August, 2006

JON W. DUDAS
*Director of the United States Patent and Trademark Office*